US008351820B2

(12) United States Patent
Kato

(10) Patent No.: US 8,351,820 B2
(45) Date of Patent: Jan. 8, 2013

(54) IMAGING UNIT AND IMAGE FORMING APPARATUS THAT ADJUST AND MODIFY A GAP BETWEEN A PHOTOCONDUCTOR DRUM AND A DEVELOPER ROLLER

(75) Inventor: Shinichi Kato, Tama (JP)

(73) Assignee: Ricoh Company, Limited, Tokyo (JP)

( * ) Notice: Subject to any disclaimer, the term of this patent is extended or adjusted under 35 U.S.C. 154(b) by 568 days.

(21) Appl. No.: 12/332,721

(22) Filed: Dec. 11, 2008

(65) Prior Publication Data

US 2009/0154955 A1 Jun. 18, 2009

(30) Foreign Application Priority Data

Dec. 12, 2007 (JP) ..... 2007-320786

(51) Int. Cl.
*G03G 21/18* (2006.01)

(52) U.S. Cl. ..... 399/113

(58) Field of Classification Search ..... 399/113
See application file for complete search history.

(56) References Cited

U.S. PATENT DOCUMENTS

| | | | | |
|---|---|---|---|---|
| 5,089,849 | A | 2/1992 | Hiraoka | |
| 6,029,031 | A | 2/2000 | Yokomori et al. | |
| 6,240,268 | B1 | 5/2001 | Nishiuwatoko | |
| 6,636,712 | B2 * | 10/2003 | Shimaoka | 399/113 |
| 2002/0071693 | A1 | 6/2002 | Shimaoka | |
| 2008/0008497 | A1 | 1/2008 | Kato | |

FOREIGN PATENT DOCUMENTS

| | | | |
|---|---|---|---|
| JP | 58-181058 | | 10/1983 |
| JP | 3-82582 | | 4/1991 |
| JP | 05232752 | A * | 9/1993 |
| JP | 6-130799 | | 5/1994 |
| JP | 6-148969 | | 5/1994 |
| JP | 07-162568 | | 6/1995 |
| JP | 09244516 | A * | 9/1997 |
| JP | 2002-91265 | | 3/2002 |
| JP | 2002-108171 | | 4/2002 |
| JP | 2006030505 | A * | 2/2006 |

OTHER PUBLICATIONS

Office Action issued May 11, 2012 in Japanese Patent Application No. 2007-320786.

* cited by examiner

*Primary Examiner* — Walter L Lindsay, Jr.
*Assistant Examiner* — Milton Gonzalez
(74) *Attorney, Agent, or Firm* — Oblon, Spivak, McClelland, Maier & Neustadt, L.L.P.

(57) ABSTRACT

An electrophotographic imaging unit includes a photoconductor housing, a developer housing, and a support. The photoconductor housing is configured to rotatably support a photoconductor drum. The developer housing is configured to accommodate developer and a developer roller. The support is configured to rotatably support the developer roller at opposite ends thereof. The photoconductor housing and the developer housing are hinged together at one side, and movable relative to each other at another side to open and close the imaging unit to sandwiched the support between the photoconductor housing and the developer housing when the imaging unit is closed.

12 Claims, 5 Drawing Sheets

IMAGING UNIT AND IMAGE FORMING APPARATUS THAT ADJUST AND MODIFY A GAP BETWEEN A PHOTOCONDUCTOR DRUM AND A DEVELOPER ROLLER

CROSS-REFERENCE TO RELATED APPLICATIONS

The present patent application claims priority pursuant to 35 U.S.C. §119 from Japanese Patent Application No. 2007-320786 filed on Dec. 12, 2007, the contents of which are hereby incorporated by reference herein in their entirety.

BACKGROUND OF THE INVENTION

1. Field of the Invention

The present invention relates to an imaging unit and an image forming apparatus using the same, and more particularly, to an electrophotographic imaging unit for use in an image forming apparatus, such as a photocopier, facsimile, and printer, and an image forming apparatus using the same imaging unit.

2. Discussion of the Background

Electrophotographic image forming systems, such as photocopiers, facsimiles, printers, etc., employ an imaging unit in which various imaging components are assembled into a single unit. A typical architecture for electrophotographic imaging includes a photoconductor section accommodating a drum-shaped photoconductor and a developer section accommodating developer and a developer applicator or roller. When assembled, the photoconductor and the developer roller have a spacing or gap therebetween, where the developer passes from one surface to another to develop an electrostatic latent image on the photoconductor into visible form during operation.

As variations in the development process greatly affect print quality of the image forming system, maintaining a consistent gap between the photoconductor surface and the developer roller surface is important.

It has been a common practice to form a photoconductor drum axis or a developer roller axis movable within the accommodating section, and to adjust the movable axis relative to the other axis to obtain a desired gap between the photoconductor and the developer roller in the assembled unit. Such gap adjustment is awkward and inefficient in terms of productivity, requiring a special tool to bring the movable axis into proper position. Further, the conventional design involves complicated assembly and disassembly of imaging components, making it difficult to manufacture and maintain the imaging unit.

To overcome such drawbacks, a hinged dual-housing imaging unit has been proposed wherein a photoconductor housing and a developer housing are connected along a common axis around which both housings are pivotable. The photoconductor housing and the developer housing rotatably hold a photoconductor drum and a developer roller, respectively, with a spacing therebetween adjustable by pivoting the housings on the common axis. Both housings have surfaces to contact or mate with each other when the imaging unit is assembled, which restrict movement or pivoting of the housings to maintain the adjusted spacing between the photoconductor drum and the developer roller. The hinged housings can be opened away from each other to facilitate assembly and disassembly of imaging components for maintenance, and the imaging unit can be restored to its proper operational position merely by contacting or mating the corresponding surfaces of the hinged housings, without any precision positioning equipment required.

Despite its advantages over the conventional design, the above-described method based on hinged housings has a drawback in that consistency of the spacing between the photoconductor drum and the developer roller cannot be ensured because it is affected by various factors such as vertical and/or horizontal misalignment between the photoconductor and the developer roller, distortion of the accommodating housings, mismatching between the contacting or mating surfaces, etc., and is therefore hard to control. Addressing this drawback by requiring tight dimensional and positional tolerances is impractical due to high costs required to manufacture various such imaging components with high precision.

Moreover, the above method has another drawback in that the drum-to-roller spacing, once determined, is hard to modify, since it requires modification on the contacting surface that is integral with the photoconductor or developer housing.

SUMMARY OF THE INVENTION

Exemplary aspects of the present invention are put forward in view of the above-described circumstances, and provide a novel electrophotographic imaging unit and an image forming apparatus using the imaging unit.

In one exemplary embodiment, the novel electrophotographic imaging unit includes a photoconductor housing, a developer housing, and a support. The photoconductor housing is configured to rotatably support a photoconductor drum. The developer housing is configured to accommodate developer and a developer roller. The support is configured to rotatably support the developer roller at opposite ends thereof. The photoconductor housing and the developer housing are hinged together at one side, and movable relative to each other at another side to open and close the imaging unit. The support is sandwiched between the photoconductor housing and the developer housing when the imaging unit is closed.

In one exemplary embodiment, the image forming apparatus includes a electrophotographic imaging unit. The imaging unit is configured to develop an electrostatic latent image into visible form, and includes a photoconductor housing, a developer housing, and a support. The photoconductor housing is configured to rotatably support a photoconductor drum. The developer housing is configured to accommodate developer and a developer roller. The support is configured to rotatably support the developer roller at opposite ends thereof. The photoconductor housing and the developer housing are hinged together at one end, and movable relative to each other at another end to open and close the imaging unit. The support is sandwiched between the photoconductor housing and the developer housing when the imaging unit is closed.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1A:
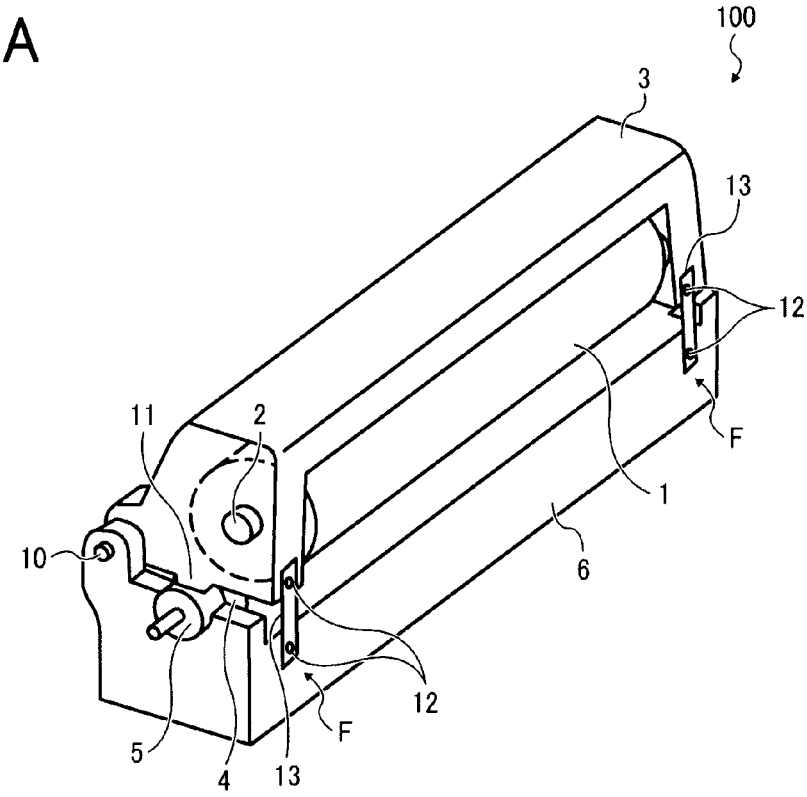
FIGS. 1A and 1B are perspective views schematically illustrating an electrophotographic imaging unit according to this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

Figure 1B:
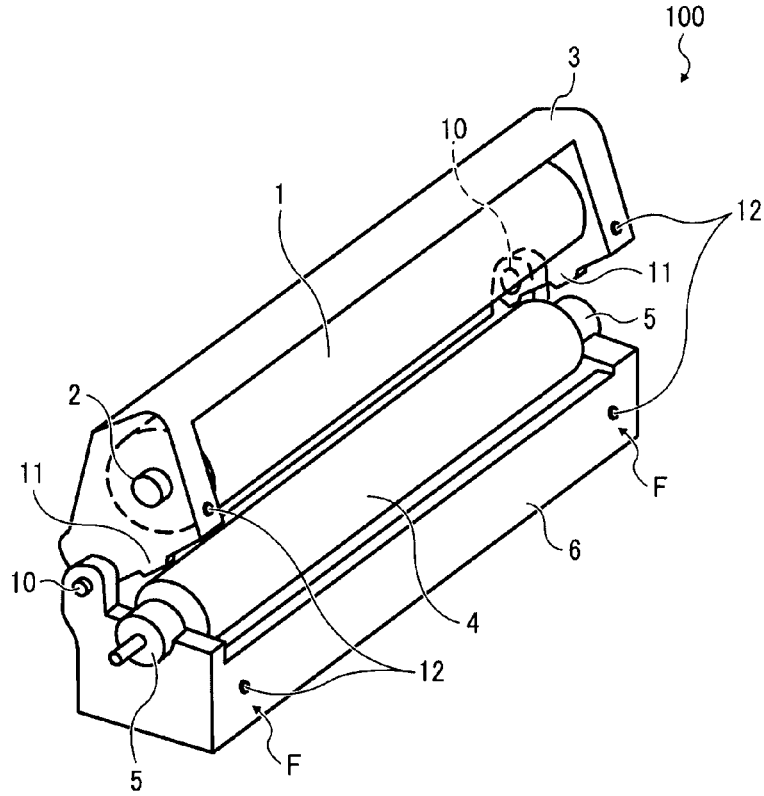

FIGS. 1A and 1B are perspective views schematically illustrating an electrophotographic imaging unit 100 according to this patent specification.

As shown in FIGS. 1A and 1B, the imaging unit 100 includes a photoconductor unit or housing 3 and a developer unit or housing 6, fastened together by a pair of pivot pins 10 on opposite lateral sides at one end, and movable relative to each other at another, free end. The photoconductor housing 3 has a pair of protrusions or feet 11, one on each side, and accommodates a drum-shaped photoconductor 1 rotatable about a flanged shaft rotatably supported by a pair of bearings 2, one on each side. The developer housing 6 holds electrophotographic developer, not shown, and has a developer applicator or roller 4 rotatable about a flanged shaft engaging a pair of supports 5, one on each side.

In the imaging unit 100, the pins 10 connecting the photoconductor housing 3 and the developer housing 6 define a hinge or common pivot axis parallel to the shaft of the photoconductor drum 1, on which both housings 3 and 6 are pivotable to open and close the imaging unit 100 while maintaining parallel alignment between the photoconductor shaft and the developer roller shaft.

With reference to FIG. 1B, the photoconductor housing 3 is retracted away from the developer housing 6 to open the imaging unit 100. The imaging unit 100 thus opened exposes the developer roller 4 and other accommodated components for user access, allowing for ready assembly and disassembly of the internal components during maintenance. To close the imaging unit 100, the photoconductor housing 3 rotates on the pivot pins 10 toward the developer housing 6, and stops where the feet 11 meet the corresponding supports 5 on opposite sides of the imaging unit 100.

With reference to FIG. 1A, when the imaging unit 100 is closed, the photoconductor housing 3 and the developer housing 6 sandwich the supports 5 therebetween on both sides, with the feet 11 resting on upper surfaces of the supports 5 to hold a given spacing or gap G between the photoconductor drum 1 and the developer roller 4. The gap G thus determined by positioning the pivotable housings 3 and 6 via the pins 10 and the supports 5 is relatively independent of dimensional or positional variations, and is therefore more stable than that obtained by directly contacting or mating a photoconductor housing and a developer housing.

The imaging unit 100 described above is used in an electrophotographic imaging system in its closed, operational position, where an electrostatic latent image is developed into visible form on the photoconductor drum 1 using developer. While not depicted in the drawing, it is to be noted that the imaging unit 100 also includes a charging device, an exposure slit, and a drum cleaner, disposed around the photoconductor 1, and a developer agitator held within the developer unit 6, as well as other components involved in the electrophotographic imaging process.

Figure 2:
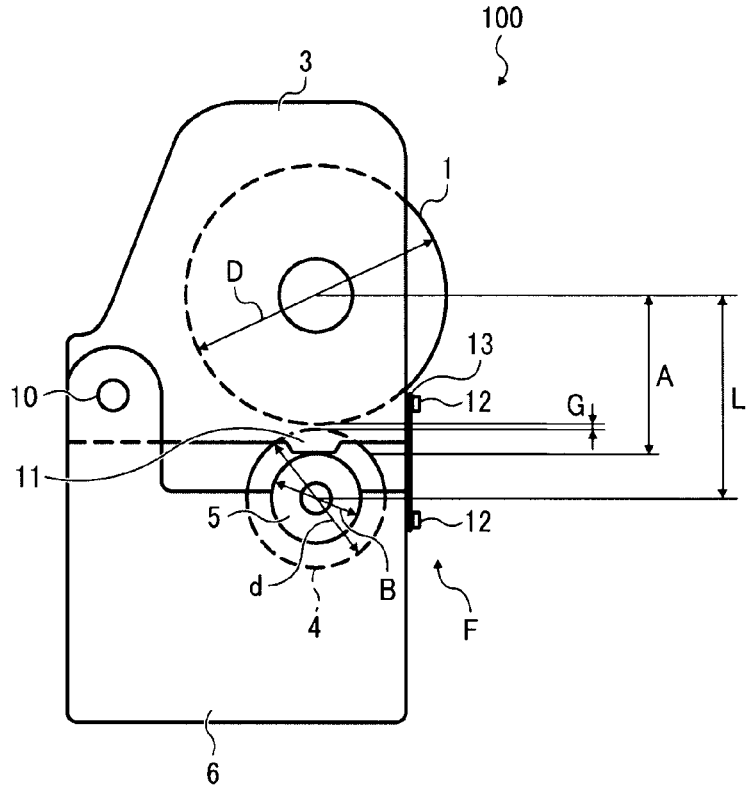
FIG. 2 is a side view schematically illustrating the imaging unit of the imaging unit of FIGS. 1A and 1B.

FIG. 2 is a side view schematically illustrating the imaging unit 100 in the closed position.

As shown in FIG. 2, the gap G between the photoconductor drum 1 and the developer roller 4 is determined as follows:

$$G=L-(D/2+d/2) \qquad \text{Equation (1)}$$

where "L" is a distance between center axes of the photoconductor 1 and the developer roller 4, "D" is a diameter of the photoconductor drum 1, and "d" is a diameter of the developer roller 4.

Assuming that the support 5 is circular in cross-section, the distance L is given as follows:

$$L=A+B/2 \qquad \text{Equation (2)}$$

where "A" is a distance or difference in level between the center of the photoconductor 1 and the bottom edge of the foot 11, and "B" is a diameter or height of the support 5.

According to Equations (1) and (2), the gap G is adjustable by modifying the dimensional factors A and/or B. For example, rearranging or replacing the support 5 to change the diameter B effectively adjusts the gap G, which is relatively easy with the openable imaging unit 100 where the hinged housings 3 and 6 can retract away from each other to provide space for maintenance operations.

With continued reference to FIGS. 1A, 1B, and 2, the imaging unit 100 has a fastening mechanism F at both ends in a long direction thereof, disposed on a side opposite the hinged side, used to lock the photoconductor housing 3 and the developer unit 6 in the closed position.

For example, the fastening mechanism F may be hooks 12 retaining a pair of elastic rubber bands 13, where each band 13 is tensioned with one end hooked to the photoconductor housing 3 and the other end hooked to the developer housing 6 on each side of the closed unit 100.

When closed and locked, the imaging unit 100 has the feet 11 on both sides of the photoconductor housing 3 pressed against the corresponding supports 5. Such pressure stabilizes the developer roller 4 in position, which is supported in the developer housing 6 without any holding mechanism except for the supports 5. Thus, the fastening mechanism F serves to securely maintain the constant gap G between the photoconductor drum 1 and the developer roller 4 in the imaging unit 100.

Figure 3:
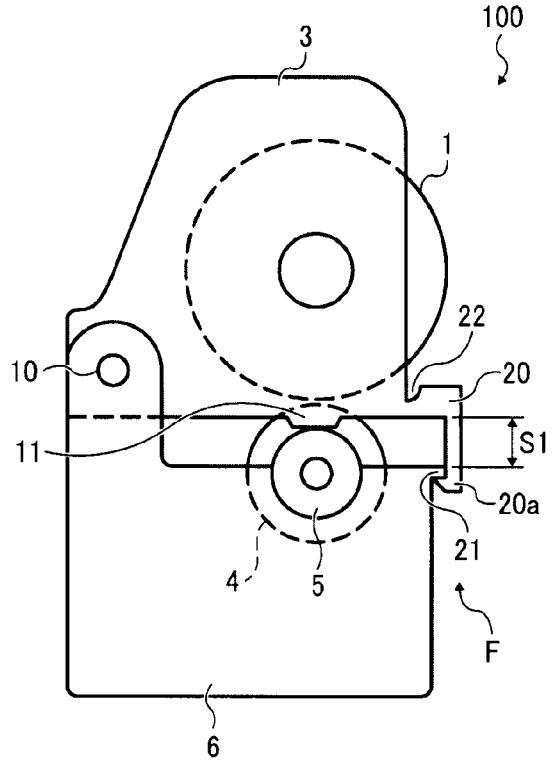
FIG. 3 is a side view schematically illustrating the imaging unit with one embodiment of a fastening mechanism according to this patent specification.

FIG. 3 is a side view schematically illustrating the imaging unit 100 with one embodiment of the fastening mechanism F. Although in FIG. 3 and in other side views the imaging unit 100 will be described with reference to one side thereof, it would be understood that the imaging unit 100 may have an identical mechanism on an opposite end thereof, and that the fastening mechanism F is provided substantially symmetrically and equidistant from a center of the photoconductor drum 1.

As shown in FIG. 3, the fastening mechanism F includes a clamp 20 integrally formed with the photoconductor housing 3, and a clamp seat 21 integrally formed with the developer housing 6. The clamp 20 has a tip 20*a* on its distal end, and a recessed portion 22 near its base or proximal end, or approximately where it begins to project from the photoconductor housing 3.

In use, the fastening mechanism F fastens the photoconductor housing 3 to the developer housing 6 by hooking the clamp tip 20*a* onto the clamp seat 21, leaving a given narrow spacing S1 between the photoconductor housing 3 and the developer housing 6. Such clamping presses the foot 11 against the support 5 on each side of the imaging unit 100, thereby securely maintaining the constant gap G between the photoconductor 1 and the developer roller 4.

In addition, while anchoring the tip 20*a* to the seat 21 applies certain forces to the fastening mechanism F, the recessed portion 22 allows the clamp 20 to elastically deform to accommodate the applied forces, which would otherwise deform the photoconductor housing 3. It is to be noted that a similar effect may be obtained by forming an elastic or deformable clamp integrally with the developer housing 6 to engage a clamp seat integrally formed with the photoconductor housing 3.

Figure 4:
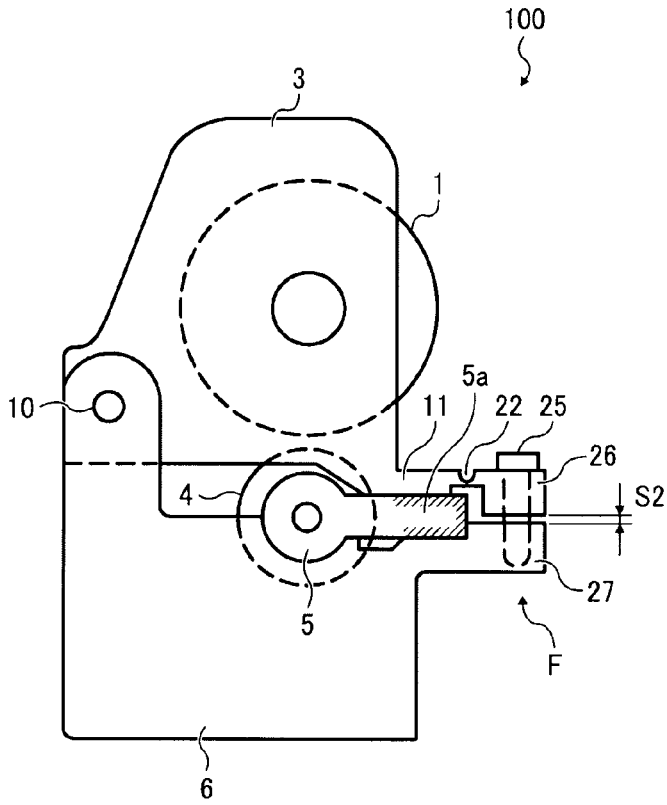
FIG. 4 is a side view schematically illustrating the imaging unit with another embodiment of the fastening mechanism.

FIG. 4 is a side view schematically illustrating the imaging unit 100 with another embodiment of the fastening mechanism F.

As shown in FIG. 4, the support 5 has an extension 5*a* held between the photoconductor housing 3 and the developer housing 6, with the foot 11 correspondingly positioned to meet the extension 5*a* in the closed position. The fastening mechanism F includes a portion 26 projecting from the photoconductor housing 3 and a portion 27 projecting from the developer housing 6, each extending beyond the extension 5*a* and having a screw hole to insert a screw 25 therethrough. The projecting portion 26 has a recessed portion 22 approximately where it extends beyond the extension 5*a*.

In use, the fastening mechanism F fastens the photoconductor housing 3 to the developer housing 6 by screwing together the portions 26 and 27, leaving a given narrow spacing S2 between the photoconductor housing 3 and the developer housing 6. Such screwing presses the foot 11 against the support extension 5*a* on each side of the imaging unit 100, thereby securely maintaining the constant gap G between the photoconductor 1 and the developer roller 4.

In addition, while tightening the screw 25 in place applies certain forces to the fastening mechanism F, the recessed portion 22 allows the portion 26 to elastically deform to accommodate the applied forces, which would otherwise deform the photoconductor housing 3.

The clamp fastener and the screw fastener described above are superior to the elastic band fastener in terms of durability, considering that rubber loses its elasticity over time and is hard to maintain. Further, the fastening mechanism F constructed with elastic deformability prevents deformation of the housings 3 and 6 due to a mismatch between the closed position and the fastening member, which would result in concomitant defects, such as distortion of printed images, or photoconductor rotation causing abnormal sounds.

Figure 5:
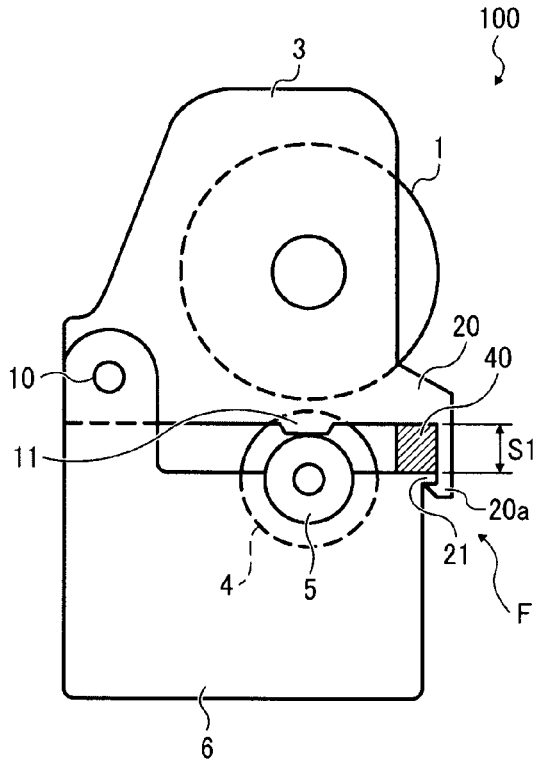
FIG. 5 is a side view schematically illustrating the imaging unit with the fastening mechanism of FIG. 3 according to further embodiment of this patent specification.

FIG. 5 is a side view schematically illustrating the imaging unit 100 with the fastening mechanism F according to a further embodiment of this patent specification.

As shown in FIG. 5, the fastening mechanism F is similar to that depicted in FIG. 3, except that the clamp 20 has no recessed portion 22 near its base, and a compressible, elastic member 40 formed of rubber or sponge rubber with a dimension greater than the spacing S1 is inserted between the photoconductor housing 3 and the developer housing 6.

In use, the fastening mechanism F fastens the photoconductor housing 3 to the developer housing 6 by clamping in a manner described above. The elastic member 40 remains compressed in the spacing S1 when the imaging unit 100 is closed and fastened, thereby preventing the clamp 20 from accidentally disengaging.

In such a configuration, the pressure exerted on the support 5 is adjustable by changing the dimensions and/or material of the elastic member 40. Also, the inserted elastic member 40 reduces stress on the clamp 20, which makes the fastening mechanism F less prone to breakage than the configuration of FIG. 3 where the clamp 20 integral with the photoconductor housing 3 deforms to accommodate applied forces.

Figure 6:
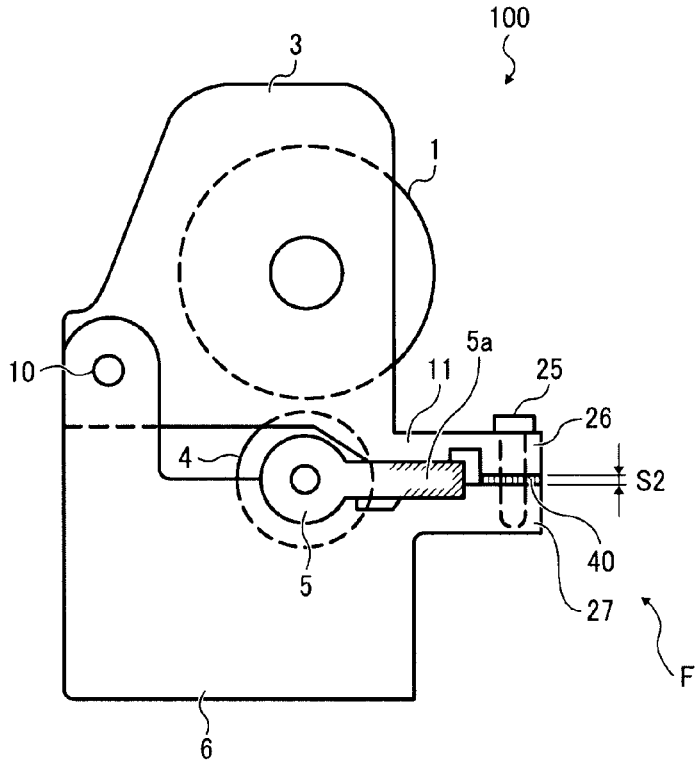
FIG. 6 is a side view schematically illustrating the imaging unit with the fastening mechanism of FIG. 4 according to further embodiment of this patent specification.

FIG. 6 is a side view schematically illustrating the imaging unit 100 with the fastening mechanism F according to a further embodiment of this patent specification.

As shown in FIG. 6, the fastening mechanism F is similar to that depicted in FIG. 4, except that the projecting portion 26 has no recessed portion 22, and a compressible, elastic member 40 formed of rubber or sponge rubber with a dimension greater than the spacing S2 is inserted between the projecting portions 26 and 27.

In use, the fastening mechanism F fastens the photoconductor housing 3 to the developer housing 6 in a manner described above. The elastic member 40 remains compressed in the spacing S2 when the imaging unit 100 is closed and fastened.

In such a configuration, the pressure exerted on the support 5 is adjustable by changing the dimensions and/or material of the elastic member 40. Also, the inserted elastic member 40 reduces stress on the projecting portion 26, which makes the fastening mechanism F less prone to breakage than the configuration of FIG. 4 where the portion 26 integral with the photoconductor housing 3 deforms to accommodate applied forces.

As mentioned, the imaging unit 100 provides the gap G between the photoconductor drum 1 and the developer roller 4 adjustable and modifiable by changing the height of the support 5. Such adjustment or modification may be done by replacing the existing support 5 with a new one, which could require costly preparation of a new mold in case the replacement is shaped by molding. In further embodiments, the imaging unit 100 facilitates adjustment of the gap G through use of a plate or spacer 31 inserted between the support 5 and the photoconductor housing 3.

Figure 7:
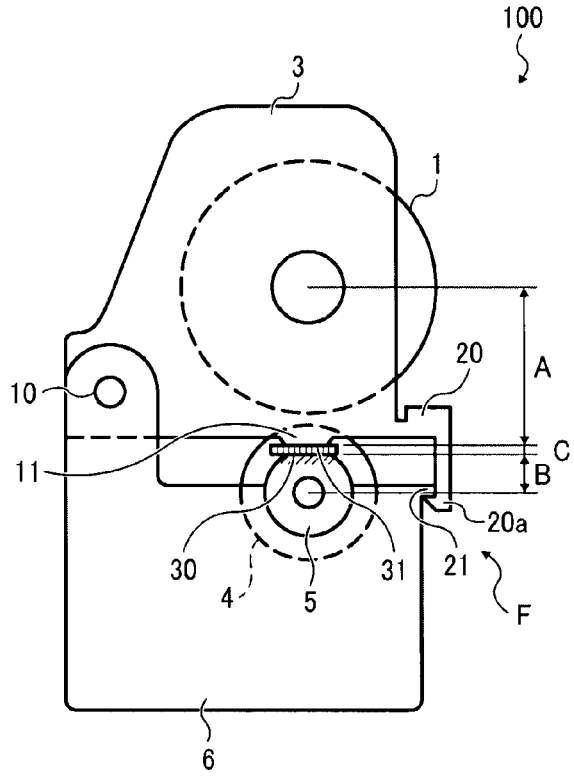
FIG. 7 is a side view illustrating the imaging unit of FIG. 3 provided with a spacer according to this patent specification.

FIG. 7 is a side view illustrating the imaging unit 100 of FIG. 3 provided with the spacer 31.

As shown in FIG. 7, the imaging unit 100 has the spacer 31 inserted between the foot 11 and the support 5, with the support 5 having a flat or moderately curved upper surface 30 to accommodate the spacer plate 31 set thereon.

In such a configuration, the distance L between the center axes of the photoconductor 1 and the developer roller 4 is determined as follows:

$$L=A+B+C \qquad \text{Equation (3)}$$

where "A" is a distance or difference in level between the center of the photoconductor 1 and the bottom edge of the foot 11, "B" is a distance or difference in level between the center of the developer roller 4 and the upper surface of the support 5, and "C" is a thickness of the spacer 31.

According to Equations 1 and 3, the gap G is adjustable by changing the spacer thickness C, which is less expensive than replacing the support 5. In addition, the spacers 31 on both sides may be independently modified to ensure that the gap G is uniform along the length of the imaging unit 100.

Figure 8:
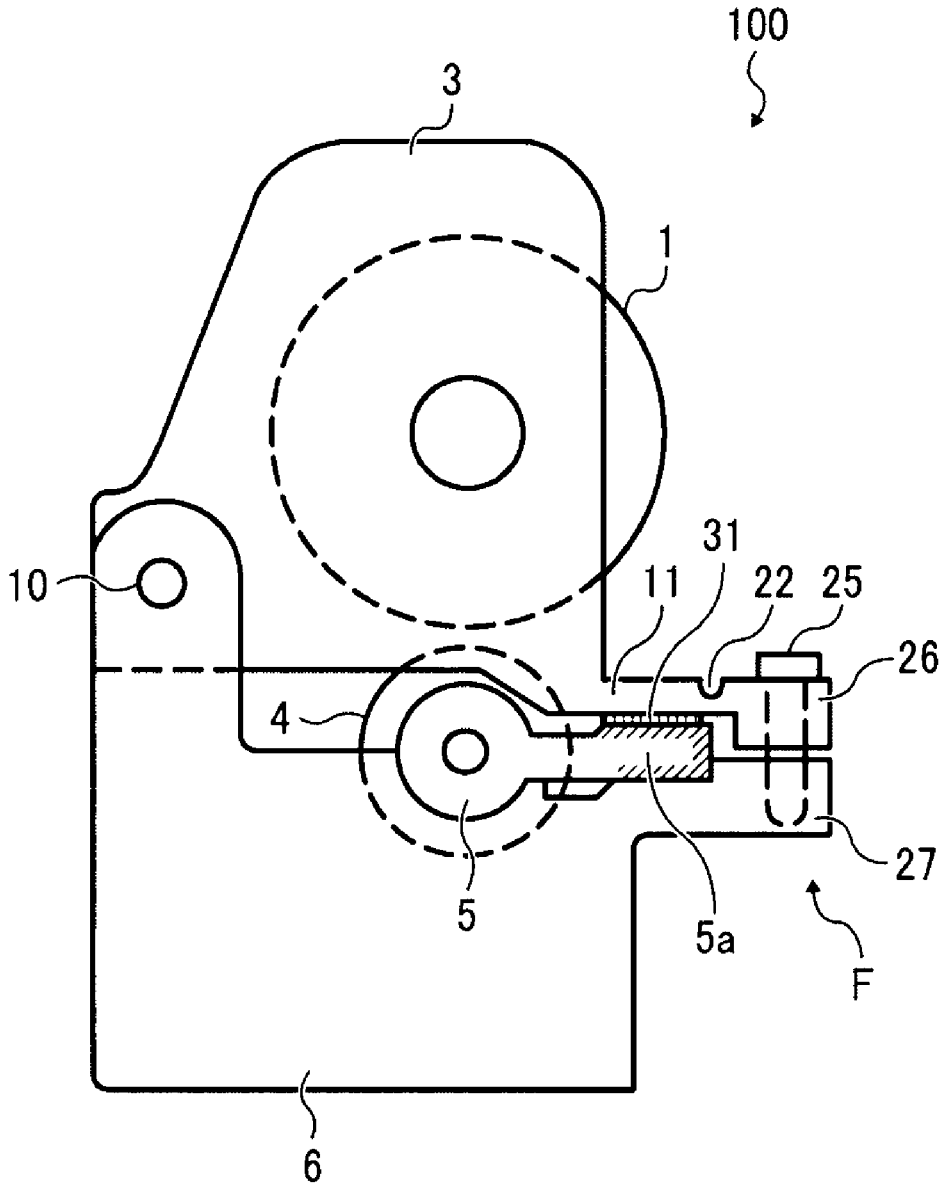
FIG. 8 is a side view schematically illustrating the imaging unit of FIG. 4 provided with the spacer.

FIG. 8 is a side view schematically illustrating the imaging unit 100 of FIG. 4 provided with the spacer 31.

As shown in FIG. 8, the imaging unit 100 has the spacer 31 inserted between the foot 11 and the support extension 5*a*, which has a flat upper surface to accommodate the spacer plate 31 set thereon.

As in the case of FIG. 7, the gap G is adjustable by changing the spacer thickness C, which is less expensive than replacing the support 5 or the support extension 5*a*. In addition, the spacers 31 on both sides may be independently modified to ensure that the gap G is uniform along the length of the imaging unit 100.

According to this patent specification, the imaging unit 100 described above is applicable to an electrophotographic image forming apparatus. Such application facilitates assembly and disassembly of imaging components while maintaining a consistent spacing between the photoconductor and the developer roller, thereby enhancing imaging quality and productivity of the image forming apparatus.

Numerous additional modifications and variations are possible in light of the above teachings. It is therefore to be understood that, within the scope of the appended claims, the disclosure of this patent specification may be practiced otherwise than as specifically described herein.

What is claimed is:

1. An electrophotographic imaging unit, comprising:

a photoconductor housing configured to rotatably support a photoconductor drum;

a developer housing configured to accommodate developer and a developer roller; and a support configured to rotatably support the developer roller at opposite ends thereof, the photoconductor housing and the developer housing being hinged together at one side, and movable relative to each other at another side to open and close the imaging unit, the support being sandwiched between the photoconductor housing and the developer housing when the imaging unit is closed, a spacer inserted between the photoconductor housing and the developer housing, the spacer being a different component from the support, the spacer having a top surface that faces the photoconductor housing and a bottom surface that faces the developer housing, an entirety of the top surface and an entirety of the bottom surface being flat and parallel to each other, and a size of a spacing between the photoconductor drum and the developer roller when the imaging unit is closed being dependent on a size of the support and the spacer.

2. The imaging unit according to claim 1, further comprising a fastening mechanism configured to fasten together the photoconductor housing and the developer housing to hold the support in place when the imaging unit is closed.

3. The imaging unit according to claim 2, wherein at least one of the photoconductor housing and the developer housing includes an elastically deformable portion as part of the fastening mechanism to fasten together the photoconductor housing and the developer housing when the imaging unit is closed.

4. The imaging unit according to claim 2, wherein the fastening mechanism includes an elastically compressible member inserted between the photoconductor housing and the developer housing when the imaging unit is closed.

5. The imaging unit according to claim 1, adjusts the spacing between the photoconductor drum and the developer roller when the imaging unit is closed.

6. The imaging unit according to claim 1, wherein a distance between the center of the developer roller and an upper surface of the support, and a thickness of the spacer are proportional to the spacing between the photoconductor drum and the developer roller when the imaging unit is closed.

7. The imaging unit according to claim 1, wherein the developer roller is engaged to the support at the center of the support.

8. The imaging unit according to claim 1, wherein the spacer contacts the support.

9. The imaging unit according to claim 1, wherein the spacer contacts the photoconductor housing.

10. The imaging unit according to claim 1, wherein the support does not contact the photoconductor housing.

11. The imaging unit according to claim 1, wherein the size of the spacing between the photoconductor drum and the developer roller when the imaging unit is closed is dependent on the entire size of the support and the spacer.

12. An image forming apparatus, comprising:

an electrophotographic imaging unit configured to develop an electrostatic latent image into visible form, the imaging unit including a photoconductor housing configured to rotatably support a photoconductor drum, a developer housing configured to accommodate developer and a developer roller, and a support configured to rotatably support the developer roller at opposite ends thereof, the photoconductor housing and the developer housing being hinged together at one side, and movable relative to each other at another side to open and close the imaging unit:, the support being sandwiched between the photoconductor housing and the developer housing when the imaging unit is closed, a spacer inserted between the photoconductor housing and the developer housing, the spacer being a different component from the support, the spacer having a top surface that faces the photoconductor housing and a bottom surface that faces the developer housing, an entirety of the top surface and an entirety of the bottom surface being flat and parallel to each other, and a size of a spacing between the photoconductor drum and the developer roller when the imaging unit is closed being dependent on a size of the support and the spacer.

* * * * *